US010401752B2

(12) United States Patent
Matsumoto et al.

(10) Patent No.: US 10,401,752 B2
(45) Date of Patent: Sep. 3, 2019

(54) IMAGE FORMING APPARATUS

(71) Applicant: CANON KABUSHIKI KAISHA, Tokyo (JP)

(72) Inventors: Atsushi Matsumoto, Toride (JP); Kiyoharu Kakomura, Nagareyama (JP); Masahiro Makino, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/899,762

(22) Filed: Feb. 20, 2018

(65) Prior Publication Data

US 2018/0246437 A1 Aug. 30, 2018

(30) Foreign Application Priority Data

Feb. 28, 2017 (JP) ..... 2017-037733

(51) Int. Cl.
*G03G 15/01* (2006.01)
*G03G 15/00* (2006.01)
(Continued)

(52) U.S. Cl.
CPC ..... *G03G 15/0194* (2013.01); *G03G 15/0136* (2013.01); *G03G 15/0173* (2013.01);
(Continued)

(58) Field of Classification Search
CPC ..... G03G 15/0136; G03G 15/0173; G03G 15/0194; G03G 15/5016; G03G 15/5041;
(Continued)

(56) References Cited

U.S. PATENT DOCUMENTS 8,494,386 B2 7/2013 Hirata
9,323,182 B2 4/2016 Makino et al.
(Continued)

FOREIGN PATENT DOCUMENTS

JP 2007-033938 A 2/2007
JP 2009-294312 A 12/2009
(Continued)

OTHER PUBLICATIONS

Combined Search and Examination Report dated Aug. 1, 2018, in UK Application No. GB1802471.1.

*Primary Examiner* — Hoang X Ngo
(74) *Attorney, Agent, or Firm* — Venable LLP

(57) ABSTRACT

An image forming apparatus includes an intermediary transfer member; a first image forming portion including a first developing device and a detecting portion; a second image forming portion including a second developing device; a contact-and-separation mechanism capable of setting a first state and a second state; and an executing portion capable of executing an operation in a first monochromatic mode in the first state and capable of executing an operation in a second monochromatic mode in the second state. When a toner amount in the first developing device is below a predetermined amount on the basis of the detecting portion during an image forming operation for continuously forming the black image in the operation in the first monochromatic mode, the executing portion continuously executes the image forming operation in the second state.

34 Claims, 8 Drawing Sheets

(51) Int. Cl.
*G03G 21/00* (2006.01)
*G03G 15/16* (2006.01)

(52) U.S. Cl.
CPC ..... *G03G 15/0189* (2013.01); *G03G 15/5041* (2013.01); *G03G 21/0011* (2013.01); *G03G 15/161* (2013.01); *G03G 15/5016* (2013.01)

(58) Field of Classification Search
CPC ..... G03G 15/161; G03G 15/0189; G03G 21/0011
See application file for complete search history.

(56) References Cited

U.S. PATENT DOCUMENTS

| | | | | |
|---|---|---|---|---|
| 2012/0275804 | A1 | 11/2012 | Watanabe | |
| 2013/0028641 | A1* | 1/2013 | Mukai ..... | G03G 15/0189 399/308 |
| 2014/0248062 | A1 | 9/2014 | Katayama | |
| 2014/0255056 | A1 | 9/2014 | Katayama | |
| 2016/0266523 | A1* | 9/2016 | Mizukoshi ..... | G03G 15/1605 |
| 2017/0227914 | A1 | 8/2017 | Ueno et al. | |

FOREIGN PATENT DOCUMENTS

| | | | |
|---|---|---|---|
| JP | 2010-066416 | A | 3/2010 |
| JP | 2011-150304 | A | 8/2011 |
| JP | 2016-114859 | A | 6/2016 |

* cited by examiner

IMAGE FORMING APPARATUS

FIELD OF THE INVENTION AND RELATED ART

The present invention relates to an image forming apparatus, such as a copying machine, a printer, a recording image display apparatus or a facsimile machine, including a developing device for developing an electrostatic latent image formed on an image bearing member by an electrophotographic process, an electrophotographic recording process or the like.

There is an image forming apparatus of a tandem type in which image forming units for forming toner images of yellow, magenta, cyan and black are provided opposed to an intermediary transfer belt and form a color image in contact with the intermediary transfer belt. In such an image forming apparatus, there is a constitution in which when a monochromatic (white-black) image is outputted using black toner, the image forming units for yellow, magenta and cyan which are not used are spaced (separated) from the intermediary transfer belt. In this constitution, in the case where an image is formed on a recording material having a thickness, a shock generating when this recording material enters a transfer portion where the image is transferred from the intermediary transfer belt onto the recording material is transmitted to the intermediary transfer belt. As a result, the shock has the influence on the image in some instances. In that regard, in order to further improve an image quality, when the image is formed on the recording material having the thickness, the image forming units which are not used are contacted to the intermediary transfer belt, so that the shock is alleviated (Japanese Laid-Open Patent Application 2009-294312).

In this constitution, photosensitive drums of the image forming units which are not used continue rotation, and therefore, friction between a cleaning blade and an associated one of the photosensitive drums increases, so that a sliding property between the cleaning blade and the photosensitive drum lowers. In order to avoid this problem, a constitution in which a toner band is supplied to the cleaning blade with a predetermined interval is employed.

However, in the case where an amount of the toner in the image forming unit is below an amount in which the toner band can be formed, when the monochromatic image is continuously formed, the cleaning blade is liable to be adversely affected. In order to avoid this problem, when image formation is stopped until the toner is supplied, long downtime generates, so that it leads to a lowering in usability for a user requiring output.

For this reason, a constitution in which an improvement in usability for the user requiring output is realized while decreasing an influence on the cleaning blade due to that the toner band cannot be formed has been desired.

SUMMARY OF THE INVENTION

A principal object of the present invention is to provide an image forming apparatus improved in usability.

According to an aspect of the present invention, there is provided an image forming apparatus comprising: an intermediary transfer member; a first image forming portion including a first image bearing member, a first developing device configured to develop, with color toner, an electrostatic latent image formed on the first image bearing member, a first cleaning blade configured to remove the toner remaining on the first image bearing member after transfer of a toner image onto the intermediary transfer member, and a detecting portion configured to detect information on an amount of the toner in the first developing device; a second image forming portion including a second image bearing member, a second developing device configured to develop, with black toner, an electrostatic latent image formed on the second image bearing member, and a second cleaning blade configured to remove the toner remaining on the second image bearing member after transfer of a toner image onto the intermediary transfer member; a contact-and-separation mechanism capable of setting a first state in which the first and second image bearing members contact the intermediary transfer member and a second state in which the first image bearing member is separated from the intermediary transfer member and the second image bearing member contacts the intermediary transfer member; and an executing portion capable of executing an operation in a first monochromatic mode in which in the first state, the first developing device forms the toner image supplied to the first cleaning blade and the second image forming portion forms a black image and capable of executing an operation in a second monochromatic mode in which in the second state, the second image forming portion forms the black image, wherein when a toner amount in the first developing device is below a predetermined amount on the basis of the detecting portion during an image forming operation for continuously forming the black image in the operation in the first monochromatic mode, the executing portion continuously executes the image forming operation in the second state.

Further features of the present invention will become apparent from the following description of exemplary embodiments with reference to the attached drawings.

DESCRIPTION OF EMBODIMENTS

Embodiments for carrying out the present invention will be described. Constitutions and means of apparatuses or devices described in the following embodiments are those for illustrating the present invention in an example, and therefore, the present invention is not limited thereto.

1. General Structure and Operation of Image Forming Apparatus

Figure 1:
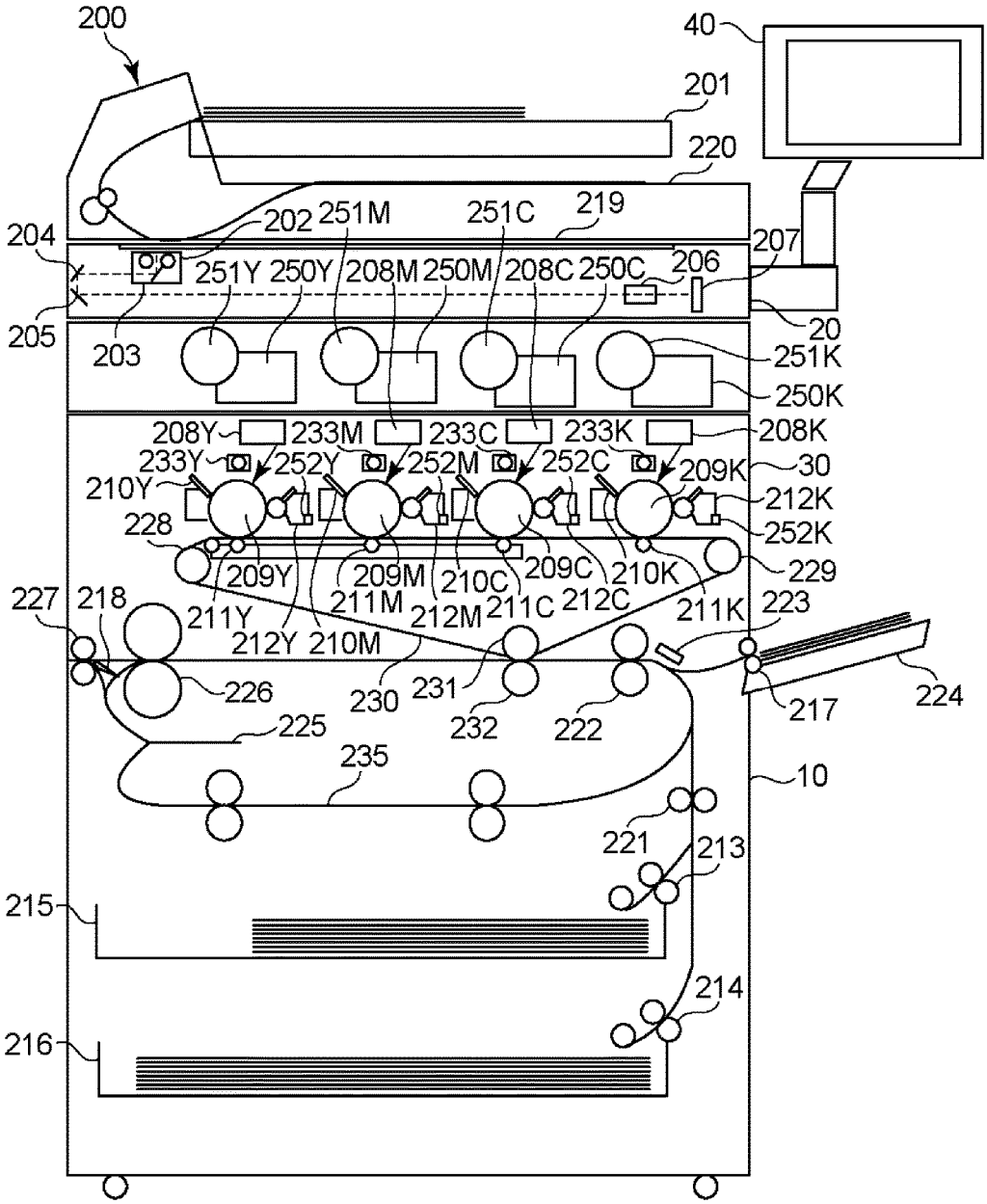
FIG. 1 is a sectional view of an image forming apparatus in Embodiment 1.

FIG. 1 is a schematic view showing a longitudinal sectional structure of a principal portion of an image forming system according to an embodiment of the present invention. An image forming apparatus 10 is of an intermediary transfer type in which four photosensitive drums (image bearing members) 209 are arranged in a tandem manner and is capable of forming a full-color image.

<Image Reading Process>

The image forming apparatus 10 in this embodiment includes an image reader 20 for reading an image from an original and a printing portion 30 for forming the image on a sheet. An original feeding device 200 feeds the original, set upward on an original tray 201, one by one successively from a first page in a leftward direction in FIG. 1. Then, the original (sheet) passes through a curved path and is fed on a platen glass 219 from left to right via a scanner unit 202 located in a home position, and is thereafter discharged onto a sheet (paper) discharge tray 220.

When this original passes through the home position of the scanner unit 202 on the platen glass 219 from left toward right, an original image is read by the scanner unit 202 disposed in the home position.

When the original passes through the home position of the scanner unit 202, a reading surface of the original is irradiated with light from the scanner unit 202, and reflected light from the original is guided to a lens 206 via mirrors 203, 204 and 205. The light passed through the lens 206 forms an image on an imaging area of an image sensor 207.

By feeding the original so as to pass through the home position of the scanner unit 202 from left toward right, an original reading operation in which a direction perpendicular to a feeding direction of the original is a main scan direction and the feeding direction is a sub-scan direction. When the original passes through the home position of the scanner unit 202, the original is fed in the sub-scan direction while reading the original image in the main scan direction for each (one) line by the image sensor 207, so that reading of an entirety of the original image is carried out. The optically read image is converted into image data by the image sensor 207 and is outputted. The image data outputted from the image sensor 207 is inputted as a video signal to an exposure portion 208 of the printing portion 30.

It is also possible to read the original by causing the original feeding device 200 to feed the original to the platen glass 219 and to stop the original at a predetermined position and by scanning the original from left to right with the scanner unit 202 in this state. This reading method is a method which is so-called original fixing reading.

When the original is read without using the original feeding device 200, first, the original feeding device 200 is raised by a user and the original is placed on the platen glass 219 by the user. Then, reading of the original is carried out by scanning the original from left to right with the scanner unit 202. When the original is read without using the original feeding device 200, the original fixing reading is carried out.

<Image Forming Process>

In this embodiment, the image forming apparatus 10 includes an image forming unit (first image forming unit) for yellow (Y), an image forming unit (second image forming unit) for black (K), an image forming unit (third image forming unit) for magenta (M) and an image forming unit (fourth image forming unit) for cyan (C). Reference numerals (symbols) described below are those common to Y, M, C and K, and as shown in FIG. 1, constituent elements (portions) for yellow, magenta, cyan and black are represented by adding symbols Y, M, C and K, respectively. In the case of an operation in a color mode, all of Y, M, C and K are subjected to an image forming operation, and in the case of an operation in a monochromatic mode, basically, only K is subjected to the image forming operation. The exposure portion 208 of the printing portion 30 modulates and outputs laser light on the basis of a video signal inputted from the image reader 20. A surface of a photosensitive drum 209, electrically charged by a charger 233, is irradiated with the laser light. On the surface of the photosensitive drum 209, an electrostatic latent image depending on the laser light scanning the original on the photosensitive drum 209 is formed. Here, the exposure portion 208 outputs the laser light during the original fixing reading so that an erect image (an image which is not a mirror image) is formed. This electrostatic latent image on the photosensitive drum 209 is visualized as a toner image with toner supplied by a developing sleeve of a developing device 212. The toner image formed on the photosensitive drum 209 is transferred onto an intermediary transfer belt (intermediary transfer member) 230 described later at a primary transfer portion. The toner remaining on the surface of the photosensitive drum 209 after the transfer of the toner image onto the intermediary transfer belt 230 is collected by a cleaning device including a cleaning blade 210.

Inside the developing device 212, a two-component developer consisting of the toner and a carrier is accommodated and a proportion (toner content) represented by a weight of the toner in the developer is 8%. Incidentally, the toner content should be properly adjusted by a toner charge amount, a carrier particle size, a structure of the developing device 212, and the like, and therefore, is not limited to 8%. The toner content in a developing container is changed by consumption of the toner, with the result that a density (content) fluctuation due to a change in toner charge amount and carrier deposition such that the carrier is deposited on the photosensitive drum, and the like phenomenon generate. For this reason, the toner content in the developing device is accurately detected, and correspondingly, supply of the toner is carried out, so that a certain image quality is maintained.

In this embodiment, as a method for detecting the toner content, an inductance sensor 252 for detecting a change in apparent (magnetic) permeability of the toner in the developer is provided in the developing device 212. For each printing, the toner content of the developer in the developing device 212 is detected by the inductance sensor 252 and is compared with a target toner content, and depending on a result thereof, a toner supply amount is determined.

The target toner content may be a predetermined value and may also be a value calculated when the developing device 212 is provided at an initial stage, but the predetermined value was used in this embodiment.

<Toner Supplying Process>

As shown in FIG. 1, a toner supplying device 250 is mounted at an upper portion of an apparatus main assembly. As a function of the toner supplying device 250, supply of the toner to the developing device 212 and supply of the toner from a toner cartridge 251 to the toner supplying device 250 itself are carried out. As an arrangement of the toner supplying device 250 in the image forming apparatus main assembly, the toner supplying device 250 has the function of supplying the toner to the developing device 212, and therefore, the toner supplying device 250 is disposed at the upper portion of the apparatus main assembly so that the toner can be supplied to the developing device 212.

Figure 2:
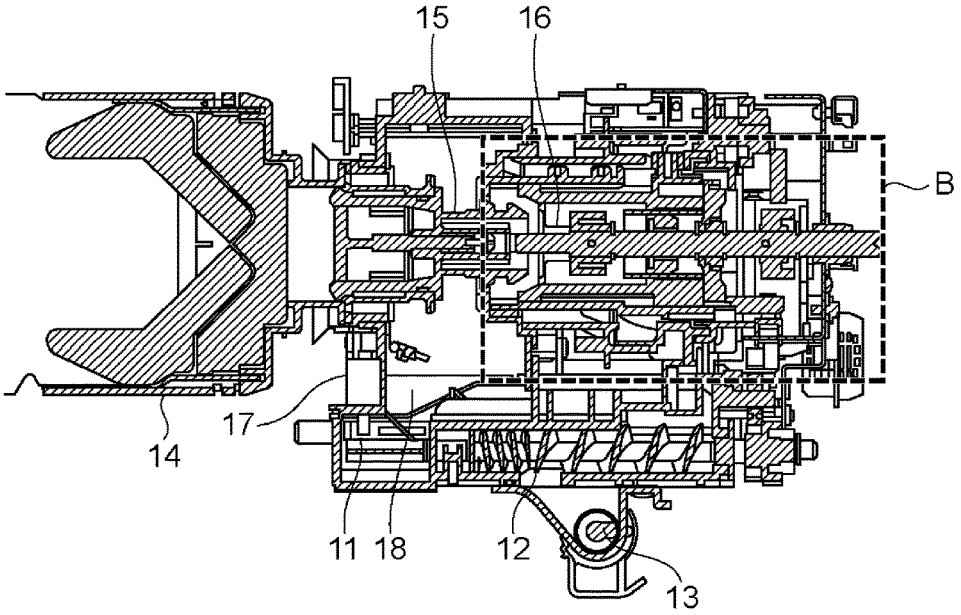
FIG. 2 is a sectional view of a toner supplying device of the image forming apparatus in Embodiment 1.

A sectional view of the toner supplying device 250 at a side surface is shown in FIG. 2. As shown in FIG. 2, as a constituent element of the toner supplying device 250, the toner cartridge 251 is set to a supply port of the toner supplying device 250. The toner from the toner cartridge 251 is stored in a toner storing portion 18. A constitution in which the stored toner is fed to the developing device 212 by screws (a stirring screw 11, a first screw 12 and a second screw 13) in the toner supplying device 250 is employed. When the toner from the toner cartridge 251 is supplied, a supply port opening and closing mechanism B engages with a cap 15 provided at a free end of the toner cartridge 251, so that the toner cartridge 251 is rotatable. Then, by rotating the toner cartridge 251, the toner can be supplied.

Next, details of the toner storing portion 18 of the toner supplying device 250 will be described. The toner in the toner supplying device 250 is in a state in which the toner storing portion 18 is usually filled with the toner. In the toner storing portion 18, a toner sensor 17 is provided, and when the toner exists on a surface of the toner sensor 17, the toner sensor 17 detects a pressure of the toner and thus a state in which the toner exists in the toner supplying device 250 is recognized. On the other hand, when the toner is supplied to the developing device 212 and then the toner in the toner storing portion 18 is consumed, the toner on the surface of the toner sensor 17 does not exist, so that a state in which the toner does not exist in the toner supplying device 250 is recognized. At that time, the toner is supplied from the toner cartridge 251 until the toner is in the state in which the toner in the toner storing portion 18 exists. The toner cartridge 251 itself has a bottle shape on which a helical shape is formed, so that the toner cartridge 251 itself rotates. As a result, the toner accommodated in the cartridge is fed to the supply port of the cartridge and then is discharged, so that the toner can be supplied to the toner storing portion 18.

<Transfer Process>

The intermediary transfer belt 230 as the intermediary transfer member is constituted by an endless belt-shaped film and is stretched by a driving roller 228, a tension roller 229 and a secondary transfer opposite roller 231 which are a plurality of stretching members. The intermediary transfer belt 230 is rotationally driven in the clockwise direction by the driving roller 228. In an inner peripheral surface side of the intermediary transfer belt 230, at a position opposing each of the photosensitive drums 209, a primary transfer roller 211 is provided. The primary transfer roller 211 is urged toward the photosensitive drum 209 through the intermediary transfer belt 230, so that a primary transfer portion (primary transfer nip) where the intermediary transfer belt 230 and the photosensitive drum 209 are in contact with each other is formed. At the primary transfer portion, the toner image formed on the photosensitive drum 209 is primary-transferred onto the intermediary transfer belt 230. In an outer peripheral surface side of the intermediary transfer belt 230, at a position opposing the secondary transfer opposite roller 231, a secondary transfer roller 232 which is a roller-shaped transfer member as a secondary transfer means is provided. The secondary transfer roller 232 is urged toward the secondary transfer opposite roller 231 through the intermediary transfer belt 230, so that a secondary transfer portion (secondary transfer nip) where the intermediary transfer belt 230 and the secondary transfer roller 232 are in contact with each other is formed. At the secondary transfer portion, the toner image on the intermediary transfer belt 230 is transferred onto a sheet (paper).

<Sheet Feeding Process>

On the other hand, the sheet fed from an upper cassette 215, provided in the printing portion 30, by a pick-up roller 213 or from a lower cassette 216, provided in the printing portion 30, by a pick-up roller 214 is fed to a registration roller pair 222 by a vertical path roller pair 221. A leading end of the sheet is detected by a pre-registration sensor 223 and is once stopped at a position where the free end reaches the registration roller pair 222. Further, a sheet fed from a manual feeding tray 224 by a manual pick-up roller 217 is similarly fed to the registration roller pair 222. The manual feeding tray 224 includes a manual feeding tray sheet detecting sensor for detecting the presence or absence of the sheet on the manual feeding tray 224, a length detecting sensor for detecting a size of the sheet on the manual feeding tray 224 with respect to a sheet feeding direction, and a width detecting sensor for detecting a size of the sheet with respect to a widthwise direction perpendicular to the sheet feeding direction.

Then, a loop is formed at a free end portion of the sheet which is fed to and once stopped at the registration roller pair 222, so that oblique movement of the sheet is corrected. Thereafter, the registration roller pair 222 is driven at arbitrary timing and the sheet is fed to the secondary transfer portion at timing in synchronism with a start of the laser light irradiation. Then, the toner image on the intermediary transfer belt 230 is secondary-transferred onto the sheet at the secondary transfer portion. The sheet on which the toner image is transferred is fed to a fixing portion 226, and is heated and pressed by the fixing portion 226, so that the toner image is fixed on the sheet. The sheet passed through the fixing portion 226 passes through a flapper 218 and a discharging roller pair 227, and is discharged from the printing portion 30 toward an outside of the image forming apparatus.

Figure 6:
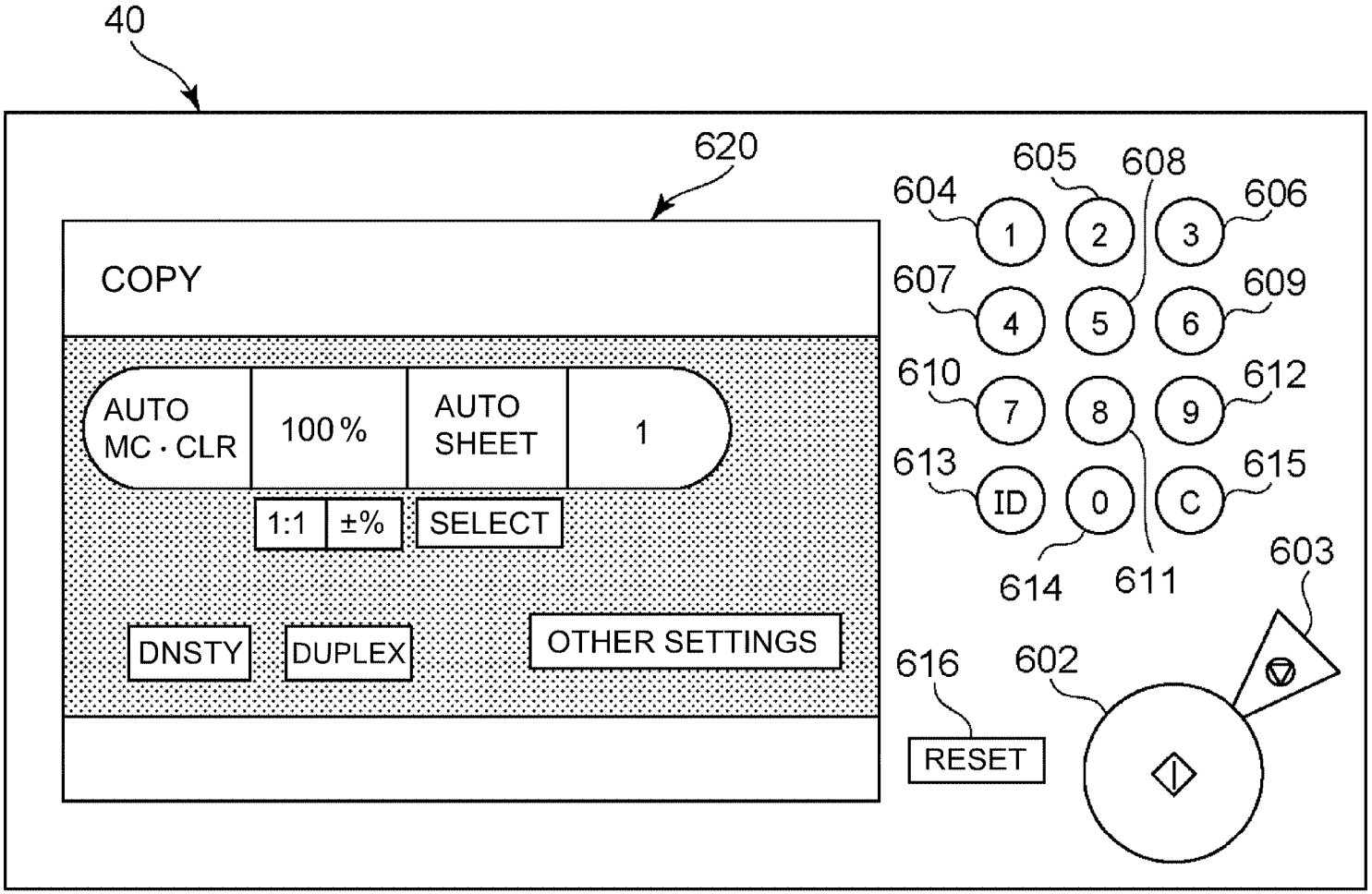
FIG. 6 is a schematic view showing an operation display device 40 in Embodiment 1.

FIG. 6 is a schematic view showing an operation display device 40 in the image forming apparatus of FIG. 1. In the operation display device 40, a start key 602 for starting the image forming operation, a stop key 603 for stopping (interrupting) the image forming operation, numeric keys 604 to 612 and 614, an ID key 613, a clear key 615, a reset key 616 and the like are provided. Further, at an upper portion, a display portion 620 where a touch panel is formed is provided, so that a softkey can be prepared on a screen.

<Primary Transfer Roller Mounting and Demounting Operation>

Figure 7:
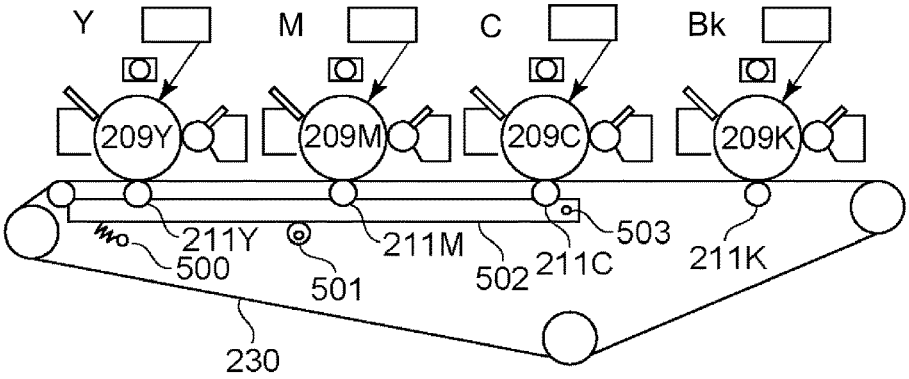
FIG. 7 is a schematic view of image forming portions during an operation in a color mode.
Figure 8:
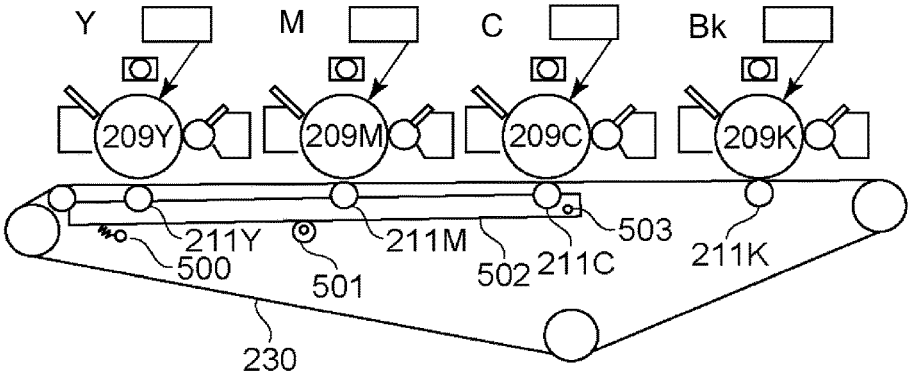
FIG. 8 is a schematic view of image forming portions during an operation in a monochromatic mode.

FIGS. 7 and 8 are schematic views of the image forming apparatus of a tandem type in which a plurality of photosensitive drums are provided. FIG. 7 shows a state (first state), during image formation, in which all the photosensitive drums 209 are contacted to the intermediary transfer belt 230. FIG. 8 is a state (second state) in an operation in a monochromatic mode (single color mode of black) in which only the photosensitive drum 209K for black is contacted to the intermediary transfer belt 230. Incidentally, members (portions) which are the same as those in FIG. 1 are represented by the same reference numerals or symbols and will be omitted from detailed description.

A primary transfer roller spacing (separating) operation (primary transfer spacing operation) will be described using FIG. 7. In this embodiment, a contact-and-separation (spacing) mechanism capable of setting the first state and the second state by switching is provided. The contact-and-separation mechanism includes a primary transfer roller holding frame 502, an eccentric cam 501 and a spring 500. In FIG. 7, when the eccentric cam 501 is rotated in a direction in which the primary transfer roller holding frame 502 is spaced (separated), the primary transfer roller holding frame 502 is spaced from the color photosensitive drums 209Y, 209M and 209C by an urging force of the spring 500. Thus, a state in which only the primary transfer roller 211K for black is contacted to the black photosensitive drum 209K is formed (FIG. 8). As a result, the intermediary transfer belt 230 is in a state in which the intermediary transfer belt 230 is contacted to only the black photosensitive drum 209K (color drum-demounted monochromatic mode). This series of operations is referred to as a primary transfer (roller) spacing operation.

A primary transfer roller contacting operation (primary transfer contacting operation) will be described using FIG. 8. In FIG. 8, when the eccentric cam 501 is rotated in a direction in which the primary transfer roller holding frame 502 is moved toward the photosensitive drums, the primary transfer roller holding frame 502 is moved (rotated) toward the color photosensitive drums 209Y, 209M and 209C by the urging force of the spring 500, so that a state in which all the primary transfer rollers 211 are contacted to the photosensitive drums 209 (FIG. 7) is formed. As a result, the intermediary transfer belt 230 is in a state in which the intermediary transfer belt 230 is contacted to all the photosensitive drums 209. This series of operations is referred to as a primary transfer (roller) contacting operation.

However, as described above, in the operation in the monochromatic mode as shown in FIG. 8, the state in which only the black photosensitive drum 209K is contacted to the intermediary transfer belt 230 is formed. For that reason, the intermediary transfer belt 230 is rotated in a state in which a load exerted on the intermediary transfer belt 230 is not so large, so that the intermediary transfer belt 230 is in a very weak state against an external load. For that reason, in the case where a sheet, such as thick paper, having a predetermined thickness or more enters the secondary transfer portion between the rollers 231 and 232 (FIG. 1) or in the case where a sheet enters the secondary transfer portion at a feeding speed not less than a predetermined speed, the intermediary transfer belt 230 is liable to cause a speed fluctuation, and therefore, shock is liable to generate. In order to alleviate the shock, the image forming apparatus in this embodiment is operable in a mode (color drum-mounted monochromatic mode) in which a monochromatic image is formed by urging the color primary transfer rollers toward the color photosensitive drums via the intermediary transfer belt depending on a kind of the sheet or paper (color drum-mounted monochromatic mode).

Embodiment 1

2. Control Mode

Figure 3:
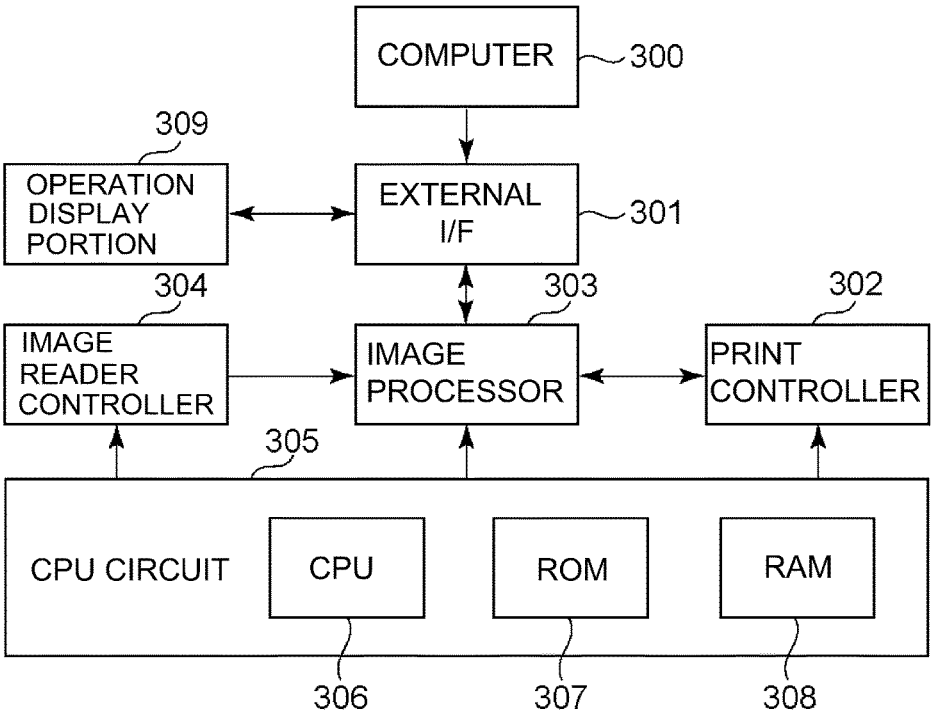
FIG. 3 is a block diagram of a system carrying out control of the image forming apparatus in Embodiment 1.

FIG. 3 is a block diagram showing a control mode of a principal part of the image forming apparatus 10 in this embodiment.

The image forming apparatus 10 includes a CPU circuit portion 305 for effecting integrated control of operations of respective portions of the image forming apparatus 10. The CPU circuit portion 305 includes a CPU 306 as a control means (executing portion) for performing a control process of the image forming apparatus 10. The CPU circuit portion 305 further includes a ROM 307 storing programs for causing the CPU 306 to operate. The CPU 306 effects the integrated control of controllers 302, 303 and 304 on the basis of the programs stored in the ROM 307. The CPU circuit portion 305 includes a RAM 308 which is a storing means used, for temporarily storing data therein, by the CPU 306. Thus, the CPU circuit portion 305 incorporates the CPU 306, the ROM 307 and the RAM 308.

An external I/F 301 sends an image forming job, inputted from a computer 300 or the operating display portion 309, to an image processing portion 303. An image reader controller 304 carries out drive control of the above-described scanner unit 202 or the like.

The image processing portion 303 converts a print job (image forming job) sent from the external I/F 301 or the image reader controller 304 into one-document-basis image data or one-page-basis image data in accordance with a control signal from the CPU 306, and sends the image data to a print controller (executing portion for executing image formation). Further, the received print job is stored, in the RAM 308, together with a reception order thereof until the job ends.

Figure 4:
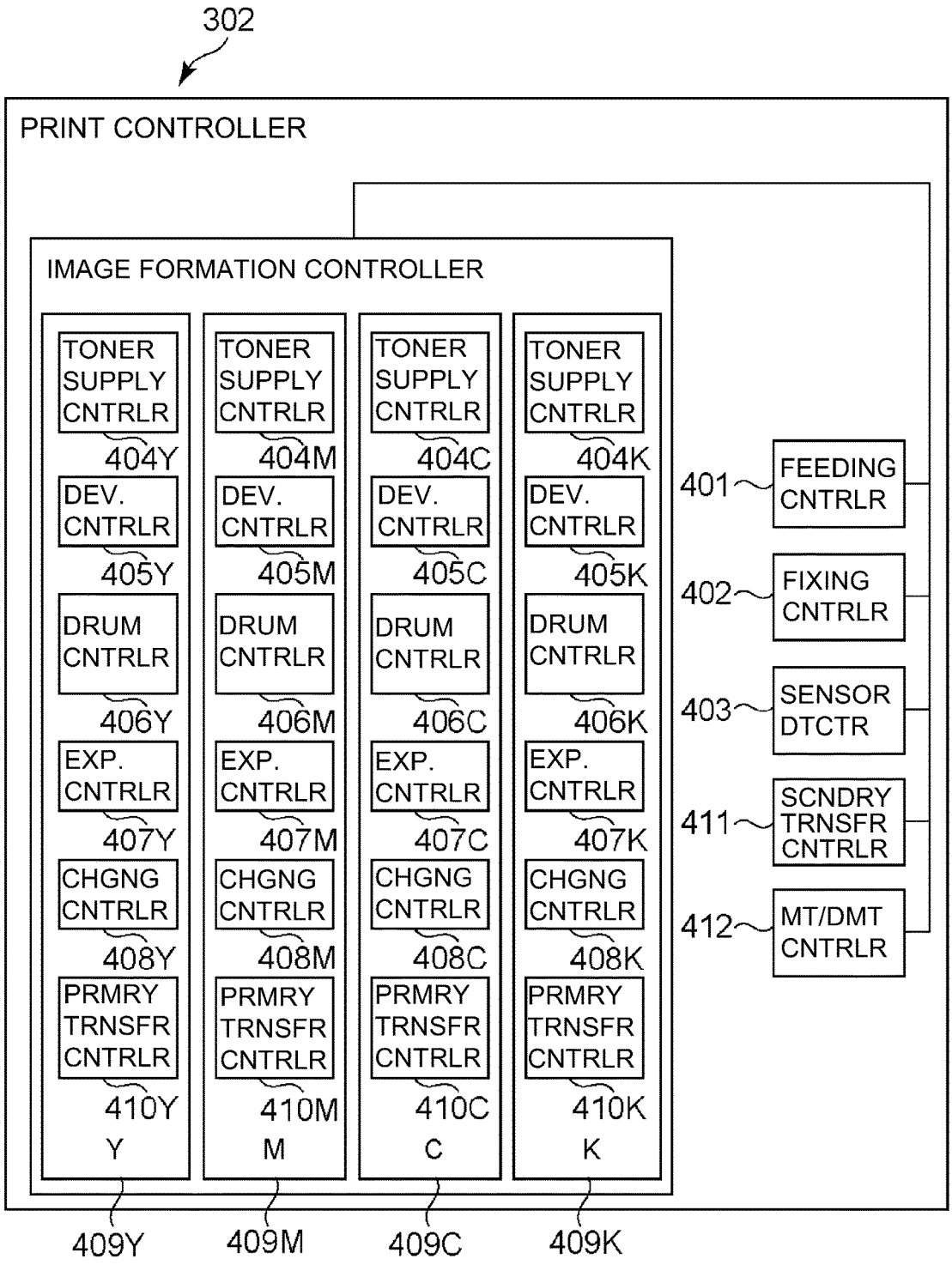
FIG. 4 is a block diagram of a print controller 302 in Embodiment 1.

The print controller 302 controls various loads for carrying out printing in accordance with the control signal from the CPU 306. FIG. 4 shows details of the print controller 302. A feeding controller 401 drives a motor, a roller, a clutch, a solenoid, a flapper and the like for supplying and feeding the sheet. A fixing controller 402 controls the fixing portion 226, so that the toner (toner image) is fixed on the sheet. A sensor detecting portion 403 reads a value of a sensor provided in the image forming apparatus. An image formation controller 409 includes a toner supplying device controller 404, a development controller 405, a photosensitive drum controller 406, an exposure controller 407, a charging controller 408 and a primary transfer controller 410, and the electrostatic latent image is developed into the toner image with the toner supplied and then the toner image is transferred onto the intermediary transfer belt 230. By a secondary transfer controller 411, the toner image on the intermediary transfer belt 230 is transferred onto the sheet. By a primary transfer mounting/demounting controller 412, the primary transfer spacing operation and the primary transfer contacting operation which are described above are performed for each of the photosensitive drums for the respective colors.

The operation display portion 309 controls the operation display device 40. The operation display portion 309 carries out control such that various inputs made by a user through the operation display device 40 are delivered to the external I/F 301. Further, the operation display portion 309 receives, from the external I/F 301, data which is necessary to be notified to the user by being displayed on the operation display device 40 as a processing result of the CPU circuit portion 305, and outputs the data to the operating display device 40.

Figure 5:
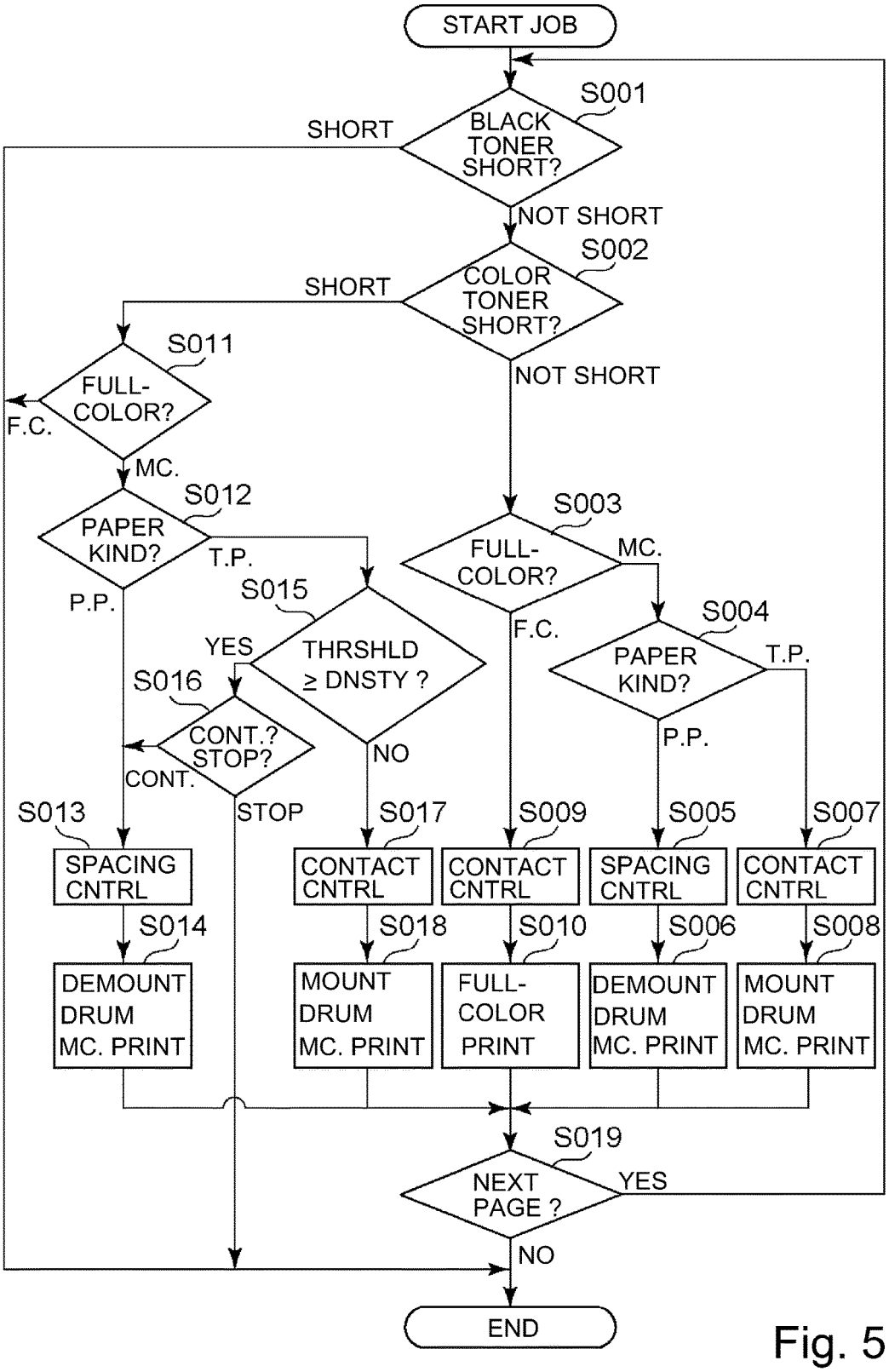
FIG. 5 is a flowchart in Embodiment 1.

FIG. 5 shows an execution flowchart in this embodiment. In this embodiment, in the case where a detection value of a toner content in the color developing devices 212Y, 212M and 212C is a predetermined threshold or less, the following selection is made. When the color toner cartridge is used up and the CPU 306 discriminates that exchange of the color toner cartridge is necessary, even in a kind of the sheet (paper) requiring printing in the operation in the color drum-mounted monochromatic mode, the printing is carried out in the operation in the color drum-demounted monochromatic mode.

In S001, the CPU 306 acquires, from the sensor detecting portion 403, the detection value of the toner sensor 17 mounted in the toner supplying device 250. Thereafter, on the basis of the program stored in the ROM 307, the CPU 306 discriminates whether or not the print can be carried out with the black toner. In the case where the black toner is insufficient, i.e., in the case where a remaining black toner amount does not reach a printable amount, the printing is ended. In the case where discrimination that the remaining black toner amount reaches the printable amount was made, in S002, the CPU 306 discriminates whether or not the color toner with a remaining toner amount which does not reach the printable amount exists. In the case where discrimination that remaining amounts of all the color toners reach the printable amount was made, in S003, the CPU 306 discriminates whether print data is to be used for the monochromatic mode or the color mode. In the case where discrimination that the print data is for the color mode was made, the CPU 306 carries out the primary transfer contacting control in S009. This is because in the case where the printing is effected in the operation in the color mode, there is a need that all the photosensitive drums 209 are contacted to the intermediary transfer belt 230. Thereafter, in S010, the CPU 306 effects the printing in the operation in a full-color mode.

In the case where in S003, discrimination that the job is constituted by continuous monochromatic jobs was made, the CPU 306 discriminates paper kind (kind of the sheet) in S004. The paper kind of the sheet set in the upper cassette 215 or the lower cassette 216 is inputted by the user through the operation display device 40. The CPU 306 discriminates whether or not the inputted paper kind causes the shock during the primary transfer spacing operation. In this embodiment, the discrimination of the paper kind was made by the input, but may also be made on the basis of an output of a sensor for detecting the kind of the recording material (sheet). In this embodiment, as a discrimination criterion, a paper basis weight of 106 gsm or more was employed. The paper with the basis weight of 106 gsm or more is referred to as thick paper, and the paper with the basis weight of less than 106 gsm is referred to as plain paper. In this embodiment, when the basis weight is the predetermined value or more, monochromatic (single-color) image formation is carried out in the operation in the color drum-mounted monochromatic mode. In the case where discrimination that the shock does not generate was made, in S005, the CPU 306 carries out the above-described primary transfer spacing control. Thereafter, in S006, the printing is carried out in the operation in the color drum-demounted monochromatic mode. During the operation in the color drum-demounted monochromatic mode, the operation of the color developing devices 212Y, 212M and 212C is at rest. In S004, discrimination that the shock generates was made, the CPU 306 carries out the above-described primary transfer contacting control in S007 and effects continuous printing in the operation in the color drum-mounted monochromatic mode. Also in this case, the operation of the color developing devices 212Y, 212M and 212C is basically at rest, but as described above, the image forming operation is started at predetermined timing, and a toner band for supplying the toner to the cleaning blade is formed. During the toner band formation, as regards various high voltages, rising and falling of drive, and detection and supply of the toner content of the developer in the color developing devices 212Y, 212M and 212C, these are carried out similarly as in the case of full-color printing. In this embodiment, for each of the colors, a solid density toner band was formed of 323 mm in main scanning width and 65 μm in sub-scanning width with a predetermined interval of once per printing of 100 sheets on an A4-size basis. As regards the toner band, as another method, a method of continuously forming a toner image with a predetermined density may also be employed.

Figure 9:
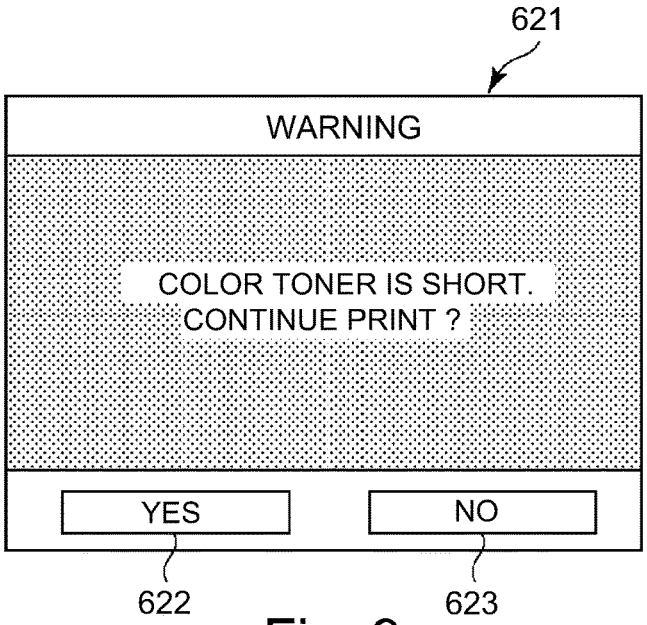
FIG. 9 is a selection screen when enablement or disablement of printing in Embodiment 1 is selected.

In S002, in the case where discrimination that there is at least one color toner for which the remaining toner amount does not reach the printable amount was made, in S011, the CPU 306 discriminates whether the job is the monochromatic job or the (full-)color job. In the case where the job was discriminated as the color job, the printing is ended. In the case where the job was the monochromatic job, in S012, the CPU 306 makes the same discrimination as that in S004. In the case where the paper kind was discriminated as the plain paper, in S013, the CPU 306 effects the primary transfer spacing control which is the same as that in S005. Then, in S014, the CPU 306 carries out the color drum-demounted monochromatic printing which is the same as that in S006. In S012, in the case where the paper kind was discriminated as the thick paper, in S015, the CPU 306 acquires, from the sensor detecting portion 403, reaction from the inductance sensors 252Y, 252M and 252C which are toner content detecting portions provided in the color developing devices 212Y, 212M and 212C. Thereafter, on the basis of the program stored in the ROM 307, the CPU 306 compares a predetermined primary transfer spacing toner content threshold with a detection toner content value (i.e., the toner content value in the developing device), of the inductance sensor 252, acquired from the sensor detecting portion 403. On a toner content basis, when "(primary transfer spacing toner content threshold)<(toner content value in developing device)" is satisfied, in S107 and S018, the CPU 306 carries out the color drum-mounted printing similar to that in S007 and S008. In this embodiment, the primary transfer spacing toner content threshold was 4.0%. On the other hand, in the case where "(primary transfer spacing toner content threshold)≥(toner content value in developing device)" is satisfied in S015 during execution of the job, in S016, the CPU 306 gives warning to the user in order to seek user's discrimination as to whether or not the print continues. As shown in FIG. 9, a character string "COLOR TONER IS SHORT. CONTINUE PRINT?" stored in the ROM 307 is outputted to the operation display device 40 as a pop-up window. The case where the user touches a NO-button 622, i.e., a state in which the printing is interrupted and the toner is supplied, is referred to as a stand-by state. Thus, in this embodiment, the stand-by state in which the toner is supplied is selectable.

In the case where the user touches a YES-button 623, i.e., the printing continues, the color drum-demounted monochromatic printing is executable in S013 and S014.

Finally, in S019, the CPU 306 discriminates whether or not there is a page to be subsequently printed during this print job, and in the case where such a page exists, a flow starting from S001 is executed again in printing of a next page, and in the case where such a page does not exist, the printing is ended. In this embodiment, even when the toner is supplied to the bottle during the print job, the printing is not returned to the color drum-mounted monochromatic printing during the print job, but the present invention is not limited thereto, so that the monochromatic printing may only be carried out after the primary transfer contact or spacing is discriminated at the toner content in the color developing device.

Figure 11:
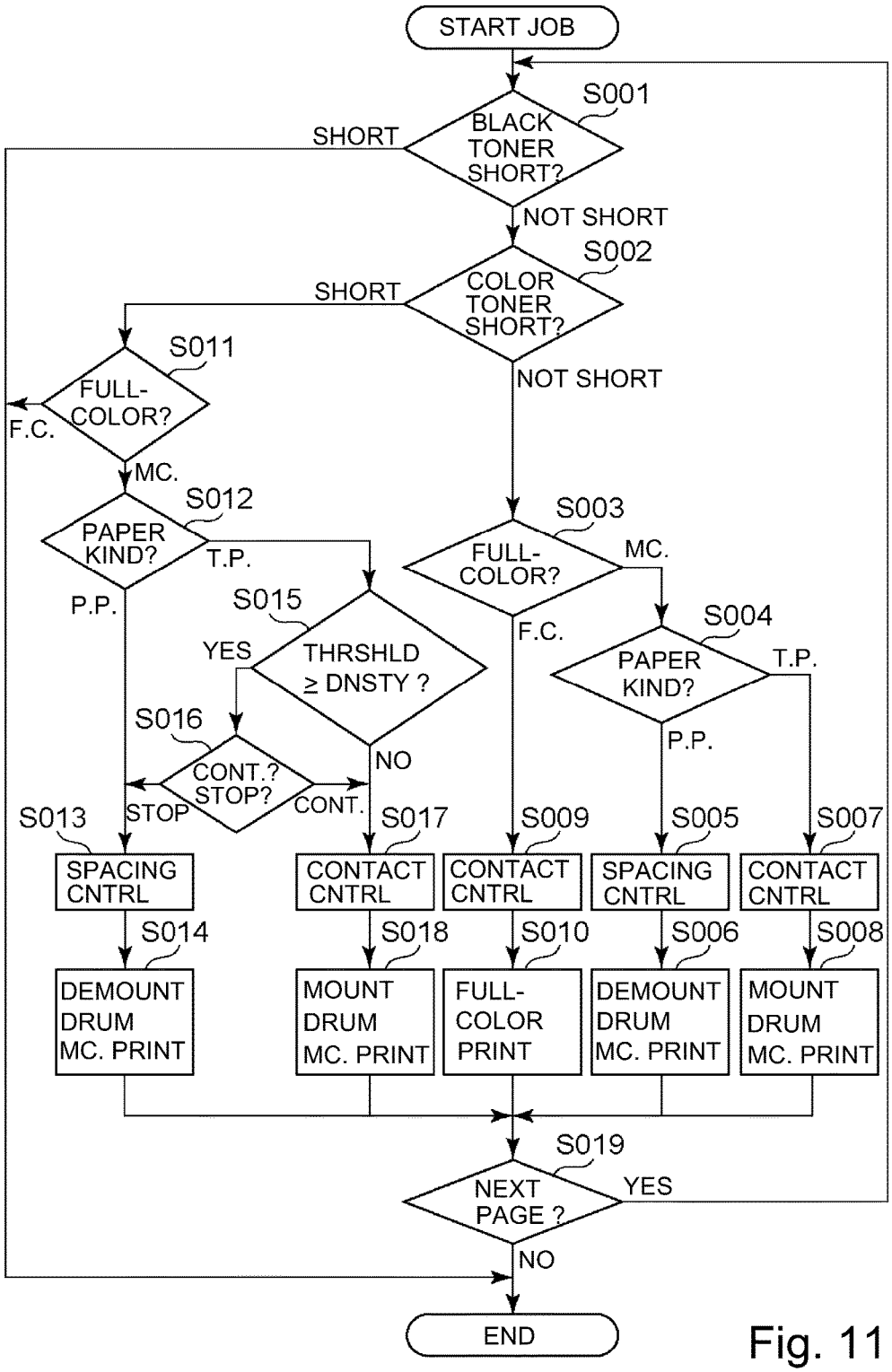
FIG. 11 is a flowchart in another example of Embodiment 1.

In this embodiment, in S016, the warning for seeking the discrimination that the print job should be continued or stopped was displayed. However, as in a flowchart shown in FIG. 11, warning for seeking discrimination as to whether or not the color drum-mounted monochromatic mode printing in which an image quality providing no shock is ensured may also be displayed. Then, in the case where the discrimination of the continuation was made, the image forming apparatus is placed in the stand-by state until the condition of (primary-transfer spacing toner content threshold)≥(toner content value in developing device) is satisfied. Further, the discrimination of S016 is omitted and the printing may also be carried out in the operation in the color drum-demounted monochromatic mode as soon as the result of S015 is "YES".

In this embodiment, as regards the discrimination in S002 and S015, when at least one color toner in the color toner cartridges is short, discrimination that the color toner is short is made, and as regards the discrimination of S015, when at least one of the color developing devices 212Y, 212M and 212C satisfies the condition ("YES"), the sequence goes to S016. However, the present invention is not limited thereto, but the discrimination may also be made for each of the colors.

Embodiment 2

Another embodiment of the present invention will be described. Elements having substantially identical or corresponding functions and constitutions to those in Embodiment 1 are represented by the same reference numerals or symbols and will be omitted from detailed description, and only a constitution portion peculiar to this embodiment will be described specifically. In Embodiment 1, in the case where the color toner cartridge is used up, even in the case of the paper kind requiring the printing in the operation in the color drum-mounted monochromatic mode, the printing was carried out in the operation in the color drum-demounted monochromatic mode depending on the detection value of the toner content in the color developing device. In this embodiment, even during the operation in the color drum-mounted monochromatic mode in the case where the color toner cartridge is used up, the printing is carried out in the operation in the color drum-demounted monochromatic mode only in the case where the detection value of the toner content in the color developing device is not more than the predetermined threshold and a remaining number of times of image formation is not less than a certain threshold (predetermined value). This is a feature of this embodiment.

During execution of a job for continuously forming images in the operation in the color drum-mounted monochromatic mode in the case where the color toner cartridge is used up, even in the case where "(primary transfer spacing toner content threshold)≥(toner content value in developing device)" is satisfied (the case of "YES" of S015 in FIG. 5), when the printing of several sheets is carried out, the influence on the image forming unit is small. Even in this case, warning is not given to the user immediately (or the sequence is not caused to go to the operation in the color drum-demounted monochromatic mode immediately), but when a remaining number of times of the print job exceeds a predetermined threshold (predetermined value), the monochromatic mode is changed to the color drum-demounted monochromatic mode. When the remaining number is smaller than the predetermined value, the printing is executed, so that user stress can be further alleviated.

Figure 10:
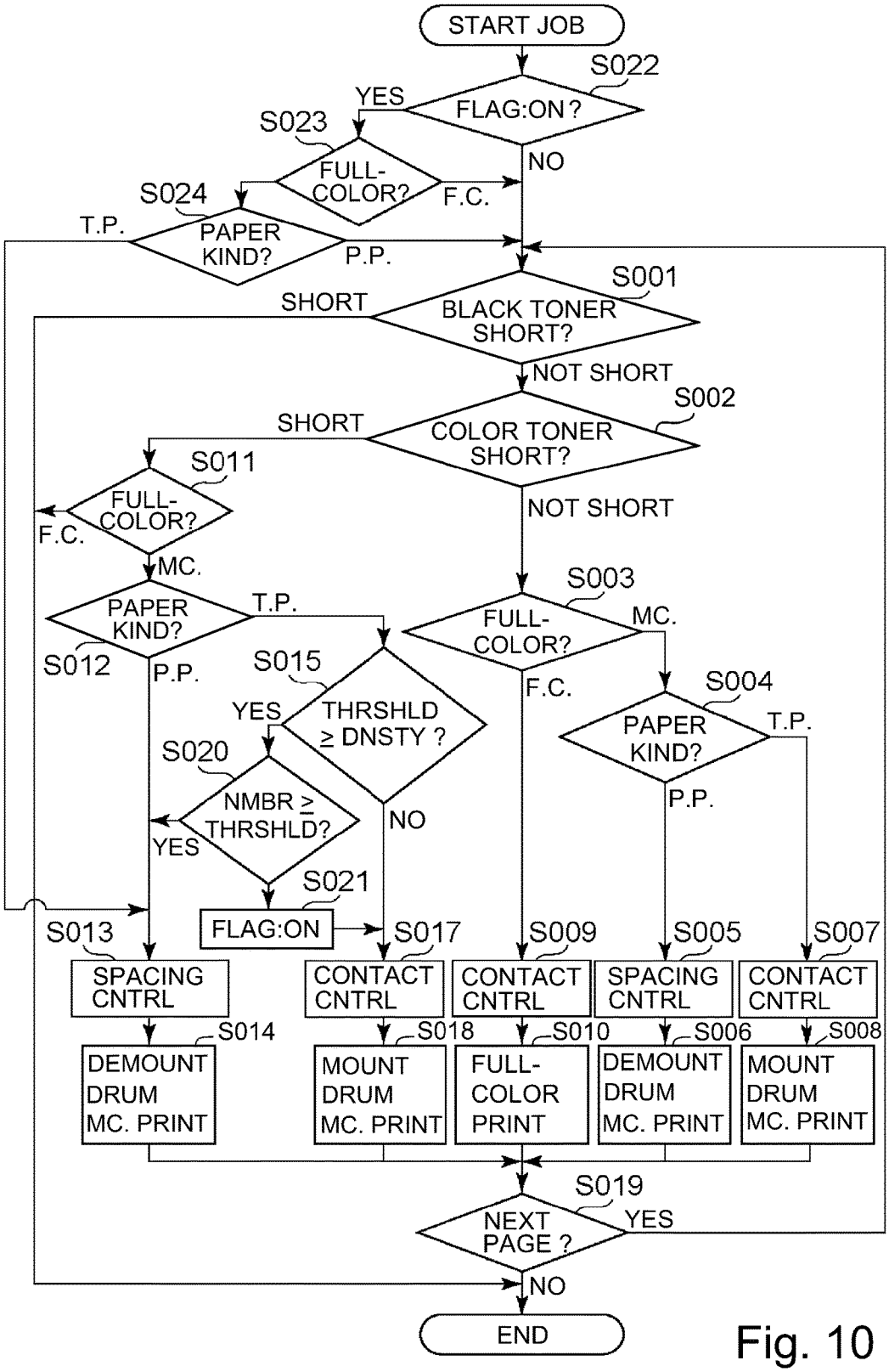
FIG. 10 is a flowchart in Embodiment 2.

FIG. 10 is an execution flowchart of this embodiment. In place of S016 of the flowchart in Embodiment 1, S020, S021, S022, S023 and S024 are added. In S015, in the case where "(primary transfer spacing toner content threshold)≥(toner content value in developing device)" is satisfied, in the case of Embodiment 1, the warning is given to the user or the sequence is immediately caused to go to the operation in the color drum demounted monochromatic mode. In this embodiment, in S020, from the print data stored in the RAM 308, a remaining print number of the job is calculated by the CPU 306 and is compared with a predetermined print threshold by the CPU 306. When "(remaining print number)≥(print threshold)" is satisfied, in S013 and S014, the color drum-demounted monochromatic printing is carried out similarly as in the case of Embodiment 1. When "(remaining print number)<(print threshold)" is satisfied, the remaining print number (remaining number of times of image formation) is small, and therefore, priority is given to usability and a stop flag is set ("ON") in S023, and thereafter in S017 and S018, the color drum-mounted monochromatic printing is carried out in this state. In this embodiment, the print threshold was set at 10 sheets. Thereafter, until the print job ends, a series of operations in the flowchart from S001 to S019 is executed. The stop flag is cleared ("OFF") at timing when the color toner cartridge is exchanged to a new color toner cartridge.

After "NO" of S020, the remaining print number only decreases monotonically during the job, and therefore, the result of S020 is continuously "NO". On the other hand, in the case where the job ends and printing starts in a new job, the stop flag is checked in S022. In S023 and S024, full-color mode/monochromatic mode of the job and the paper kind in the job, respectively, are checked. Only when the stop flag is "ON" and printing in the operation in the monochromatic mode and with thick paper is to be executed, the color drum-demounted monochromatic printing is unconditionally carried out in S013 and S014. In the case other than this case, the flowchart is similar to that starting from S001. As a result, in the apparatus in the state in which the stop flag is once set ("ON"), the influence on the image forming unit due to continuous execution of the thick paper monochromatic job of a small (short) print number of not more than the print threshold without exchanging the color toner cartridge is reduced.

In this embodiment, the constitution in which the remaining toner amount was discriminated by the toner content in the developing device was employed. As another constitution, the above-described control may also be carried out in the case where the detection value of the toner amount detecting sensor for detecting the toner amount in the toner storing portion of the toner supplying device is smaller than a predetermined amount, for example. This is because even in this case, there is no case that the toner amount in the developing device is below the predetermined amount.

In the above-described embodiments, the two-component developer was described, but even when a one-component developer is used, a similar effect can be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-037733 filed on Feb. 28, 2017, which is hereby incorporated by reference herein in its entirety.

What is claimed is:

1. An image forming apparatus comprising:

an intermediary transfer member;

a first image forming portion including a first image bearing member, a first developing device configured to develop, with color toner, an electrostatic latent image formed on said first image bearing member, a first cleaning blade configured to remove the toner remaining on said first image bearing member after transfer of a toner image onto said intermediary transfer member, and a detecting portion configured to detect a value relating to an amount of the toner in said first developing device;

a second image forming portion including a second image bearing member, a second developing device configured to develop, with black toner, an electrostatic latent image formed on said second image bearing member, and a second cleaning blade configured to remove the toner remaining on said second image bearing member after transfer of a toner image onto said intermediary transfer member;

a contact-and-separation mechanism capable of switching a state of said first and second image bearing members between a first state in which said first and second image bearing members contact said intermediary transfer member and a second state in which said first image bearing member is separated from said intermediary transfer member and said second image bearing member contacts said intermediary transfer member; and an executing portion capable of executing an image forming operation in a first black monochromatic mode in which in the first state, said first developing device is capable of forming a toner image to be supplied to said first cleaning blade and said second image forming portion forms a black image to be transferred to a recording material and capable of executing an image forming operation in a second black monochromatic mode in which in the second state, said second image forming portion forms the black image to be transferred to a recording material, wherein when a toner amount in said first developing device is below a predetermined amount on the basis of said detecting portion during an image forming operation for continuously forming the black image to be transferred to a recording material in the image forming operation in the first black monochromatic mode, said executing portion is capable of continuously executing the image forming operation in the second state.

2. An image forming apparatus according to claim 1, further comprising an operating portion configured to select a stand-by state in which when a toner amount in said second developing device is below a predetermined amount during the image forming operation for continuously forming the black image in the operation in the first black monochromatic mode, said image forming apparatus discontinues image formation until the toner amount exceeds the predetermined amount on the basis of said detecting portion in order to continue the image formation in the first state.

3. An image forming apparatus according to claim 1, wherein during execution of the operation in the first black monochromatic mode, said first developing device forms the toner image, for each of predetermined intervals, having a predetermined length with respect to a rotational direction of said first image bearing member.

4. An image forming apparatus according to claim 1, wherein said first developing device includes a developer including color toner and a carrier, and said detecting portion is an inductance sensor configured to detect a toner content relative to the developer.

5. An image forming apparatus according to claim 1, wherein when the toner in said second developing device is below a predetermined amount during the image forming operation for continuously forming the black image in the operation in the first black monochromatic mode, in a case where a remaining number of times of the image formation is fewer than a predetermined value, said executing portion continuously executes the image formation in the first state.

6. An image forming apparatus according to claim 1, wherein said executing portion selects the monochromatic mode so that the operation in the first black monochromatic mode is executed when a basis weight of a recording material is greater than a predetermined value and so that the operation in the second black monochromatic mode is executed when the basis weight of the recording material is less than the predetermined value.

7. An image forming apparatus according to claim 1, wherein said second cleaning blade removes a developer remaining on said second image bearing member after transfer.

8. An image forming apparatus according to claim 1, further comprising:

a third image forming portion including a third image bearing member, a third developing device configured to develop, with color toner, an electrostatic latent image formed on said third image bearing member, and a third cleaning blade configured to remove the toner remaining on said third image bearing member after transfer of a toner image onto said intermediary transfer member, wherein said third image forming portion is configured to form an image on said intermediary transfer member; and a fourth image forming portion including a fourth image bearing member, a fourth developing device configured to develop, with color toner, an electrostatic latent image formed on said fourth image bearing member, and a fourth cleaning blade configured to remove the toner remaining on said fourth image bearing member after transfer of a toner image onto said intermediary transfer member, wherein said fourth image forming portion is configured to form an image on said intermediary transfer member, wherein when a toner amount in any one of said first, third, and fourth developing devices is below a predetermined amount, said executing portion continuously executes the image forming operation in the second state.

9. An image forming apparatus according to claim 1, wherein when the toner amount in said first developing device is below a predetermined amount on the basis of said detecting portion, information on toner supply is displayed.

10. An image forming apparatus comprising:

an intermediary transfer member;

a first image forming portion including a first image bearing member, a first developing device configured to develop, with color toner, an electrostatic latent image formed on said first image bearing member, a first cleaning blade configured to remove the toner remaining on said first image bearing member after transfer of a toner image onto said intermediary transfer member, and a detecting portion configured to detect a value relating to an amount of the toner in said first developing device;

a second image forming portion including a second image bearing member, a second developing device configured to develop, with black toner, an electrostatic latent image formed on said second image bearing member, and a second cleaning blade configured to remove the toner remaining on said second image bearing member after transfer of a toner image onto said intermediary transfer member;

a contact-and-separation mechanism capable of switching a state of said first and second image bearing members between a first state in which said first and second image bearing members contact said intermediary transfer member and a second state in which said first image bearing member is separated from said intermediary transfer member and said second image bearing member contacts said intermediary transfer member;

an executing portion capable of executing an image forming operation in a first black monochromatic mode in which in the first state, said first developing device forms the toner image to be supplied to said first cleaning blade and said second image forming portion forms a black image to be transferred to a recording material and capable of executing an image forming operation in a second black monochromatic mode in which in the second state, said second image forming portion forms the black image to be transferred to a recording material; and an operating portion configured to select, when a toner amount in said first developing device is below a predetermined amount on the basis of said detecting portion during an image forming job for continuously forming the black image in the image forming operation in the first black monochromatic mode, continuation of the image forming job in a state in which said operating portion switches the mode in the image forming operation from the first black monochromatic mode to the second black monochromatic mode.

11. An image forming apparatus according to claim 10, wherein the operating portion is configured to select a stand-by state in which, when a toner amount in said second developing device is below a predetermined amount during the image forming operation for continuously forming the black image in the image forming operation in the first black monochromatic mode, said image forming apparatus discontinues image formation until the toner amount exceeds the predetermined amount on the basis of said detecting portion in order to continue the image formation in the first state.

12. An image forming apparatus according to claim 10, wherein during execution of the image forming operation in the first black monochromatic mode, said first developing device forms the toner image, for each of predetermined intervals, having a predetermined length with respect to a rotational direction of said first image bearing member.

13. An image forming apparatus according to claim 10, wherein said first developing device includes a developer including color toner and a carrier, and said detecting portion is an inductance sensor configured to detect a toner content relative to the developer.

14. An image forming apparatus according to claim 10, wherein when the toner in said second developing device is below a predetermined amount during the image forming operation for continuously forming the black image in the image forming operation in the first black monochromatic mode, in a case where a remaining number of times of the image formation is fewer than a predetermined value, said executing portion continuously executes the image formation in the first state.

15. An image forming apparatus according to claim 10, wherein said executing portion selects the monochromatic mode so that the image forming operation in the first black monochromatic mode is executed when a basis weight of a recording material is greater than a predetermined value and so that the image forming operation in the second black monochromatic mode is executed when the basis weight of the recording material is less than the predetermined value.

16. An image forming apparatus according to claim 10, wherein said second cleaning blade removes a developer remaining on said second image bearing member after transfer.

17. An image forming apparatus according to claim 10, further comprising:

a third image forming portion including a third image bearing member, a third developing device configured to develop, with color toner, an electrostatic latent image formed on said third image bearing member, and a third cleaning blade configured to remove the toner remaining on said third image bearing member after transfer of a toner image onto said intermediary transfer member, wherein said third image forming portion is configured to form an image on said intermediary transfer member; and a fourth image forming portion including a fourth image bearing member, a fourth developing device configured to develop, with color toner, an electrostatic latent image formed on said fourth image bearing member, and a fourth cleaning blade configured to remove the toner remaining on said fourth image bearing member after transfer of a toner image onto said intermediary transfer member, wherein said fourth image forming portion is configured to form an image on said intermediary transfer member, wherein when a toner amount in either one of said third and fourth developing devices is below a predetermined amount, said executing portion continuously executes the image forming operation in the second state.

18. An image forming apparatus according to claim 10, wherein when the toner amount in said first developing device is below a predetermined amount on the basis of said detecting portion, information on toner supply is displayed.

19. An image forming apparatus comprising:

an intermediary transfer member;

a first image forming portion including a first image bearing member, a first developing device configured to develop, with color toner, an electrostatic latent image formed on said first image bearing member, a first cleaning blade configured to remove the toner remaining on said first image bearing member after transfer of a toner image onto said intermediary transfer member, and a detecting portion configured to detect a value relating to an amount of the toner in said first developing device;

a second image forming portion including a second image bearing member, a second developing device configured to develop, with black toner, an electrostatic latent image formed on said second image bearing member, and a second cleaning blade configured to remove the toner remaining on said second image bearing member after transfer of a toner image onto said intermediary transfer member;

a contact-and-separation mechanism capable of switching a state of said first and second image bearing members between a first state in which said first and second image bearing members contact said intermediary transfer member and a second state in which said first image bearing member is separated from said intermediary transfer member and said second image bearing member contacts said intermediary transfer member; and an executing portion capable of executing an image forming operation in a first black monochromatic mode in which in the first state, said first developing device is capable of forming the toner image to be supplied to said first cleaning blade and said second image forming portion forms a black image to be transferred to a recording material and capable of executing an image forming operation in a second black monochromatic mode in which in the second state, said second image forming portion forms the black image to be transferred to a recording material, wherein when a job for executing the image forming operation in the first black monochromatic mode is inputted in a state in which a toner amount in said first developing device is below a predetermined amount on the basis of said detecting portion, said executing portion is capable of executing the job in the second black monochromatic mode.

20. An image forming apparatus according to claim 19, further comprising an operating portion configured to select a stand-by state in which the first black monochromatic mode is switched to the second black monochromatic mode and the job is not executed, and said image forming apparatus discontinues image formation until the toner amount exceeds the predetermined amount on the basis of said detecting portion in order to start the image formation in the first black monochromatic mode.

21. An image forming apparatus according to claim 19, wherein during execution of the image forming operation in the first black monochromatic mode, said first developing device forms the toner image, for each of predetermined intervals, having a predetermined length with respect to a rotational direction of said first image bearing member.

22. An image forming apparatus according to claim 19, wherein said first developing device includes a developer including color toner and a carrier, and said detecting portion is an inductance sensor configured to detect a toner content relative to the developer.

23. An image forming apparatus according to claim 19, wherein said executing portion selects the monochromatic mode so that the image forming operation in the first black monochromatic mode is executed when a basis weight of a recording material is greater than a predetermined value and so that the image forming operation in the second black monochromatic mode is executed when the basis weight of the recording material is less than the predetermined value.

24. An image forming apparatus according to claim 19, wherein said second cleaning blade removes a developer remaining on said second image bearing member after transfer.

25. An image forming apparatus according to claim 19, further comprising:

a third image forming portion including a third image bearing member, a third developing device configured to develop, with color toner, an electrostatic latent image formed on said third image bearing member, and a third cleaning blade configured to remove the toner remaining on said third image bearing member after transfer of a toner image onto said intermediary transfer member, wherein said third image forming portion is configured to form an image on said intermediary transfer member; and a fourth image forming portion including a fourth image bearing member, a fourth developing device configured to develop, with color toner, an electrostatic latent image formed on said fourth image bearing member, and a fourth cleaning blade configured to remove the toner remaining on said fourth image bearing member after transfer of a toner image onto said intermediary transfer member, wherein said fourth image forming portion is configured to form an image on said intermediary transfer member, wherein when a toner amount in any one of said first, third, and fourth developing devices is below a predetermined amount, said executing portion continuously executes the image forming operation in the second state.

26. An image forming apparatus according to claim 19, wherein when the toner amount in said first developing device is below a predetermined amount on the basis of said detecting portion, information on toner supply is displayed.

27. An image forming apparatus comprising:

an intermediary transfer member;

a first image forming portion including a first image bearing member, a first developing device configured to develop, with color toner, an electrostatic latent image formed on said first image bearing member, a first cleaning blade configured to remove the toner remaining on said first image bearing member after transfer of a toner image onto said intermediary transfer member, and a detecting portion configured to detect a value relating to an amount of the toner in said first developing device;

a second image forming portion including a second image bearing member, a second developing device configured to develop, with black toner, an electrostatic latent image formed on said second image bearing member, and a second cleaning blade configured to remove the toner remaining on said second image bearing member after transfer of a toner image onto said intermediary transfer member;

a contact-and-separation mechanism capable of switching a state of said first and second image bearing members between a first state in which said first and second image bearing members contact said intermediary transfer member and a second state in which said first image bearing member is separated from said intermediary transfer member and said second image bearing member contacts said intermediary transfer member;

an executing portion capable of executing an image forming operation in a first black monochromatic mode in which in the first state, said first developing device is capable of forming a toner image to be supplied to said first cleaning blade and said second image forming portion forms a black image to be transferred to a recording material and capable of executing an image forming operation in a second black monochromatic mode in which in the second state, said second image forming portion forms the black image to be transferred to a recording material; and an operating portion configured to select, when a job for executing the operation in the first black monochromatic mode is inputted in a state in which a toner amount in said first developing device is below a predetermined amount on the basis of said detecting portion, a start of an image forming job in a state in which said operating portion switches a mode in the image forming operation from the first black monochromatic mode to the second black monochromatic mode.

28. An image forming apparatus according to claim 27, wherein the operating portion is configured to select a stand-by state in which the first black monochromatic mode is switched to the second black monochromatic mode and the job is not executed, and said image forming apparatus discontinues image formation until the toner amount exceeds the predetermined amount on the basis of said detecting portion in order to start the image formation in the first black monochromatic mode.

29. An image forming apparatus according to claim 27, wherein during execution of the image forming operation in the first black monochromatic mode, said first developing device forms the toner image, for each of predetermined intervals, having a predetermined length with respect to a rotational direction of said first image bearing member.

30. An image forming apparatus according to claim 27, wherein said first developing device includes a developer including color toner and a carrier, and said detecting portion is an inductance sensor configured to detect a toner content relative to the developer.

31. An image forming apparatus according to claim 27, wherein said executing portion selects the monochromatic mode so that the image forming operation in the first black monochromatic mode is executed when a basis weight of a recording material is greater than a predetermined value and so that the image forming operation in the second black monochromatic mode is executed when the basis weight of the recording material is less than the predetermined value.

32. An image forming apparatus according to claim 27, wherein said second cleaning blade removes a developer remaining on said second image bearing member after transfer.

33. An image forming apparatus according to claim 27, further comprising:

a third image forming portion including a third image bearing member, a third developing device configured to develop, with color toner, an electrostatic latent image formed on said third image bearing member, and a third cleaning blade configured to remove the toner remaining on said third image bearing member after transfer of a toner image onto said intermediary transfer member, wherein said third image forming portion is configured to form an image on said intermediary transfer member; and a fourth image forming portion including a fourth image bearing member, a fourth developing device configured to develop, with color toner, an electrostatic latent image formed on said fourth image bearing member, and a fourth cleaning blade configured to remove the toner remaining on said fourth image bearing member after transfer of a toner image onto said intermediary transfer member, wherein said fourth image forming portion is configured to form an image on said intermediary transfer member, wherein when a toner amount in either one of said third and fourth developing devices is below a predetermined amount, said executing portion continuously executes the image forming operation in the second state.

34. An image forming apparatus according to claim 27, wherein when the toner amount in said first developing device is below a predetermined amount on the basis of said detecting portion, information on toner supply is displayed.

* * * * *